United States Patent [19]

Tajima et al.

[11] Patent Number: 4,838,815

[45] Date of Patent: Jun. 13, 1989

[54] CONNECTOR ASSEMBLY

[75] Inventors: Kyousuke Tajima, Sawa; Goro Itoi, Maebashi; Mitsuo Sorimachi, Isesaki, all of Japan

[73] Assignee: Hosiden Electronics Co., Ltd., Osaka, Japan

[21] Appl. No.: 97,773

[22] Filed: Sep. 18, 1987

[30] Foreign Application Priority Data

Sep. 26, 1986 [JP] Japan ..... 61-147555[U]
Sep. 26, 1986 [JP] Japan ..... 61-147556[U]
Sep. 26, 1986 [JP] Japan ..... 61-147557[U]

[51] Int. Cl.[4] ..... H01R 13/33

[52] U.S. Cl. ..... 439/841; 439/840; 439/817

[58] Field of Search ..... 439/817, 818, 840, 841

[56] References Cited

U.S. PATENT DOCUMENTS 4,620,761 11/1986 Smith et al. ..... 439/817

FOREIGN PATENT DOCUMENTS 45606 6/1956 Fed. Rep. of Germany ..... 439/817

*Primary Examiner*—Gil Weidenfeld

*Attorney, Agent, or Firm*—Pollock, VandeSande and Priddy

[57] ABSTRACT

A plurality of spring housing holes are formed in a first surface of an insulation block of a socket connector, and contact insertion holes are formed in a second surface of the block in communication with the spring housing holes. In each spring housing hole, a coil spring is housed, and the insulation block holds a terminal connected to the corresponding coil spring. A plurality of plug contacts are arranged and embedded in an insulation body of a plug connector. When the plug contacts are inserted into the contact insertion holes, the plug contacts are inserted and engaged between coils of the coil springs to connect the plug contacts and springs electrically with each other.

10 Claims, 9 Drawing Sheets

CONNECTOR ASSEMBLY

BACKGROUND OF THE INVENTION

This invention relates to a connector assembly for electrically connecting a socket connector and a plug connector.

A conventional socket connector is shown in FIG. 1. An annular recess 2 is formed in the front face of a body 1 made of an insulation material. A plurality of contact insertion holes 3 are formed in a portion of the body 1 inside the annular recess 2. In the contact insertion holes 3, socket contacts are housed although not illustrated in the Figure. Terminals 4, integratedly formed with the socket contacts, are led outwardly from the bottom face of the body 1.

Referring to FIG. 2, each socket contact 5 to be mounted in the hole 3 is formed to extend in back and forth directions, the rear end of an extension 5*c* of the socket contact 5 being bent and extended downwardly to form a terminal 4. The socket contact 5 is provided with a pair of opposite pinching pieces 5*a* and 5*b*, the rear parts of which are integrated with both front edges of the extension 5*c*. When a plug connector (not illustrated) is coupled with the socket connector of FIG. 1, the plug contacts are inserted into the contact insertion holes 3, and are thereby resiliently engaged with the socket contacts 5, completing electrical connection. The terminal 4 and the socket contact 5 are integrally formed by pressing a metal plate. Therefore, there was a limit in the extent to which they could be machined to make them smaller. With an excessively small structure in use, the resiliency of the contact often became poor, and particularly fragile against the twisting force from the inserted plug contact. Where the connector is used for connecting two printed circuit boards, even a slight deviation between the plug connector and the socket connector often caused deformation of the contracts to such a degree that the contacts could not be used any longer.

SUMMARY OF THE INVENTION

An object of this invention is to provide a connector assembly that can be made small and thin with stable and good electric connection.

Another object of the present invention is to offer a connector assembly that can greatly absorb positional displacement produced between the plug connector and the socket connector when two printed circuit boards are connected with each other, etc.

Still another object of the present invention is to offer a socket connector that is more resistant to the twisting force of the plug contact, even though the socket connector is fabricated in reduced sizes.

Still another object of the present invention is to offer a socket connector which allows use of an automatic machine for assembling terminals into the socket connector.

Still another object of this invention is to provide a plug connector which will not crush an associated coil spring even when the winding of the coil spring is tilted.

Still another object of the present invention is to provide a connector assembly which requires adequately large removing and plugging forces.

According to the principles of the present invention, spring housing holes are formed in a surface of a square column-shaped insulation block of the socket connector. Coil springs are housed in the spring housing holes in a freely expansible manner in their axial directions. A contact insertion hole, communicated to each spring housing hole, is formed in the insulation block, towards the peripheral surface of the coil spring. A terminal, electrically connected to each coil spring, is led outside the insulation block.

A plurality of the spring housing holes are arranged in a line. A pair of ridges, extended parallel to the aligning direction of the spring housing holes, are formed integrally with the insulation block, on both sides of the spring housing holes. A pair of slots are formed in the pair of ridges in opposing relation to each other across each spring housing hole. Through each pair of the slots, on end portion of the terminal is inserted to cross a corresponding one of the spring housing holes. Each coil spring thus comes in resilient contact with the corresponding terminal, achieving an electrical connection therebetween.

Plug contacts are embedded on the front side of the insulation body of the plug connector. As the plug contacts are inserted into the contact insertion holes of the socket connector, a tip of each plug contact forcefully enters between adjacent coils of the coil spring while separating the adjacent coils, thus engaging in-between the adjacent coils and completing an electrical contact between the coil spring and the plug contact. The other end of each plug contact is led outwardly from the insulation body of the plug connector to serve as a terminal.

The plug contact is formed in a strip shape. A part of its tip is formed sharp enough in the lateral direction so that the plug contact will not crush the coil spring, but is robustly engaged between coils of the coil spring. In addition, a boss is provided on one surface of the plug contact, with which a suitable inserting and removing force can be obtained when the plug contact is engaged with the coil spring.

DETAILED DESCRIPTION OF PREFERRED EMBODIMENTS

Figure 1:
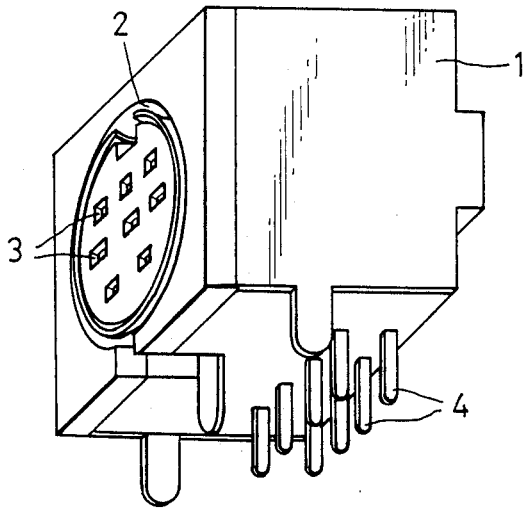
FIG. 1 PRIOR ART
FIG. 1 is an oblique view showing a conventional socket connector.
Figure 2:
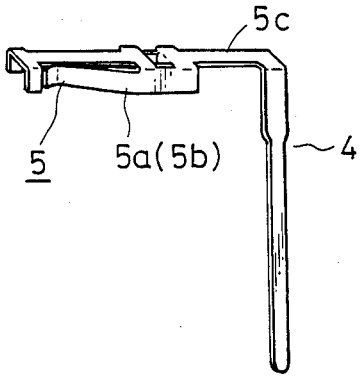
FIG. 2 PRIOR ART
FIG. 2 is also an oblique view of a socket contact to be used for the socket connector of FIG. 1.
Figure 3:
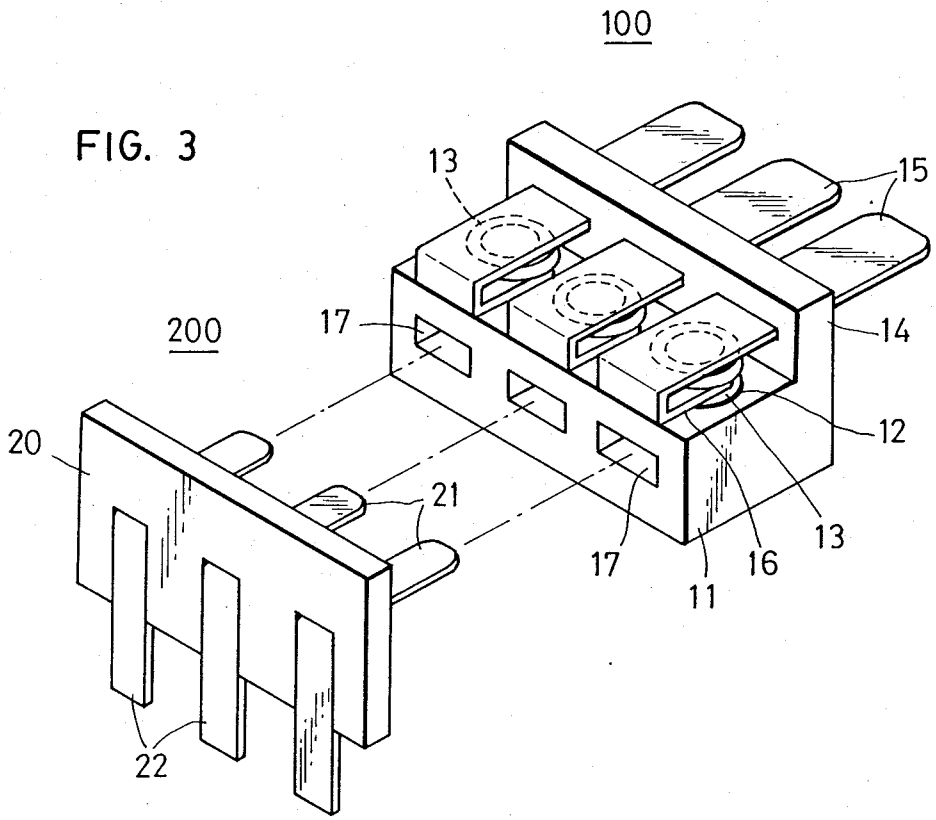
FIG. 3 shows an oblique view of a connector assembly according to the present invention.
Figure 4:
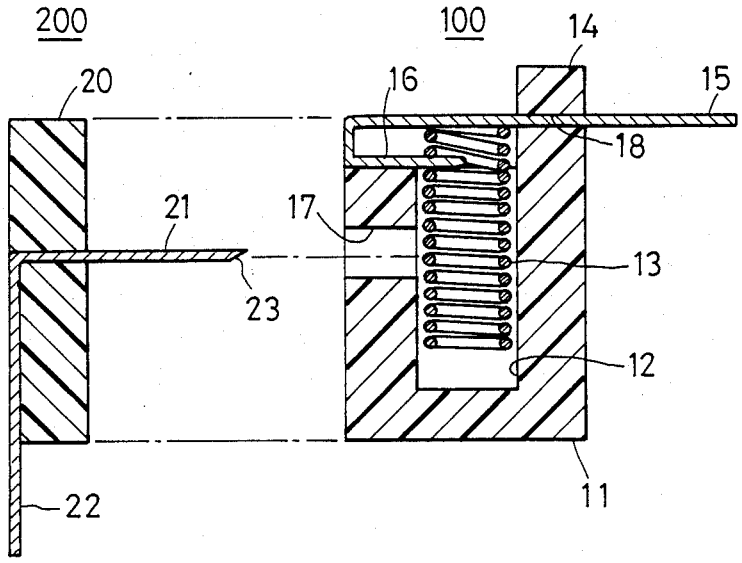
FIG. 4 is a sectional view of the connector assembly shown in FIG. 3.

Referring to FIGS. 3 and 4, a socket connector 100 comprises an insulation block 11 made of a synthetic resin in a square column shape. A plurality of spring housing holes 12 are formed in a row along one side of the insulation block 11. Coil springs 13 are housed in the spring housing holes 12, serving as contacts. A ridge 14 is formed on one surface of the block 11 in which the spring housing holes 12 are formed. Terminals 15 are press-inserted and supported in slits 18 formed through the ridge 14. Each terminal 15 is extended from the slit 18 beyond the opening of the corresponding spring housing hole 12, with its end being folded back in a U-shape. Its folded part 16 is engaged with the end of the corresponding coil spring 13, thus the coil spring 13 and the terminal 15 are electrically connected. Contact insertion holes 17 are formed in the front side of the insulation block 11 in communication with the spring housing holes 12. Each contact insertion hole 17 faces the side of the barrel of the coil spring 13.

A plug connector 200 comprises an insulation body 20 made of a synthetic resin and a plurality of strip-shaped plug contacts 21 embedded in the insulation body 20. These plug contacts 21 are inserted in the contact insertion holes 17 of the socket connector 100, where the tip of each plug contact 21 forcefully enters the coil spring 13 to be clipped between adjacent coils of the coil spring 13, assuring an electrical contact. Thereby, the plug contacts 21 and the terminals 15 of the socket connector 100 are electrically connected to one another.

In this embodiment, each plug contact 21 of the plug connector 200 is bent rectangularly on the rear side of the insulation body 20 to extend beyond the edge of the insulation body 20, thus working as a terminal 22 of the plug connector 200.

Figure 5:
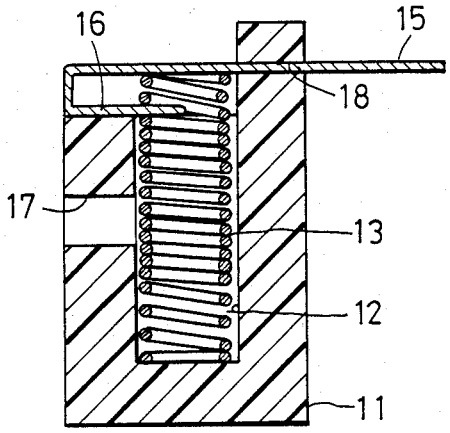
FIG. 5 is a sectional view of a socket connector based on the present invention, in which a part of the coil spring 13 is normally coiled.

Each of the coil spring 13 is of dense winding and is disposed in the spring housing hole 12 while leaving a gap between the bottom of the spring housing hole 12 and the coil spring 13 as shown in FIG. 4, which allows the coil spring 13 to expand and contract in the axial direction. According to another configuration based on the present invention, the center part of the coil spring may be of dense winding while both end parts of the coil spring are of gapped winding (normal coiling) as shown in FIG. 5. The coil spring 13 is housed in the spring housing hole 12 while being slightly compressed. As is evident from the foregoing description, the thickness of the plug contact 21 is made larger than the gap between coils of the coil spring 13. The coil spring 13 may advantageously be plated with silver, etc.

Figure 6:
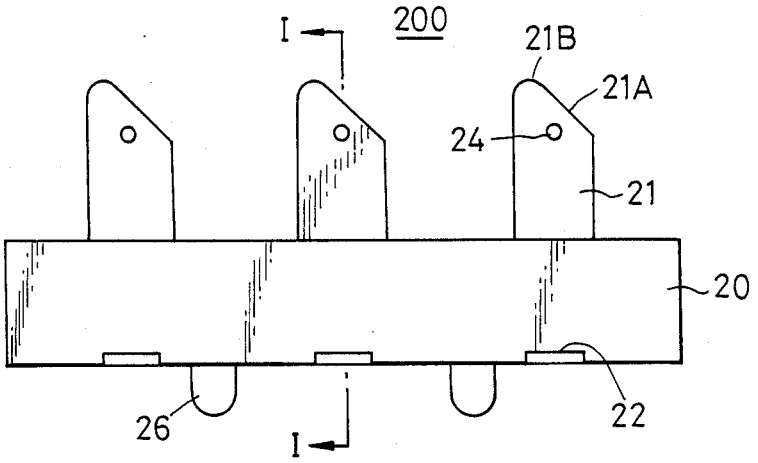
FIG. 6 shows another embodiment of the plug connector according to the present invention, in a plan view.

Referring to FIG. 6 that shows an alternative form of plug connector 200, each plug contact 21 comprises a knife-shaped conducting body, at an end portion of which is formed a pointed part 21B. More explicitly with this example, a diagonal edge 21A is formed across the width of the plug contact 21, defining the pointed part 21B on the left side of the contact 21 in FIG. 6.

Figure 7:
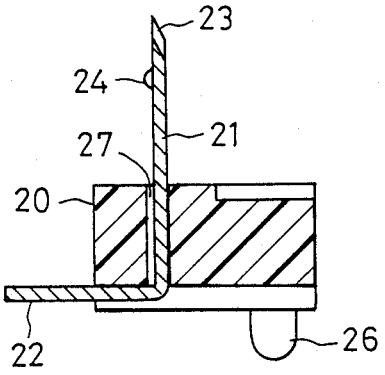
FIG. 7 is a sectional view along line I—I in FIG. 6.

Along the contour of the diagonal edge 21A and the pointed part 21B, a taper face 23 is formed as shown in FIG. 7. Thus, a sharp edge is formed at the end portion of the plug contact 21 by means of this taper face 23. In this example, a plurality of protuberances 26 are formed on a face of the insulation body 20 (rear face), namely a surface to come in contact with a printed circuit board. These protuberances 26 are fitted into holes formed in the printed circuit board, thereby facilitating the positioning of the plug connector 200.

On each plug contact 21, a boss 24 is formed on the plate, as shown in FIGS. 6 and 7, for example, by pressing a metal plate constituting the plug contact 21 from one side. The boss 24 is located advantageously within the range of a distance smaller than the diameter of the coil spring 13, from the tip of the plug contact 21.

The plug contacts 21 are press-inserted in slits formed in the insulation body 20. This press-insertion is carried out by an automated machine. More explicitly, the contacts 21 are forced into the slits formed in the insulation body 20, with one ends of the terminals 22 of the contacts 21 still connected together with a connecting member (not shown). After completion of the press-insertion, the connecting member that connects the terminals 22 is cut off to isolate and separate each of the terminals 22. In addition, a groove 27 is formed in an inner wall surface of each slit laterally centrally thereof, as shown in FIG. 7, for allowing passage of the boss 24 during the press-insertion step.

Figure 8:
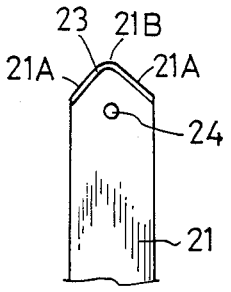
FIGS. 8–10 show other embodiments of the plug contact based on the present invention.
Figure 9:
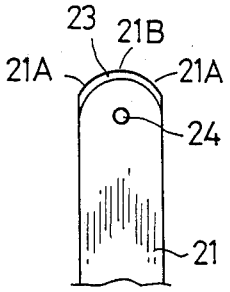
Figure 10:
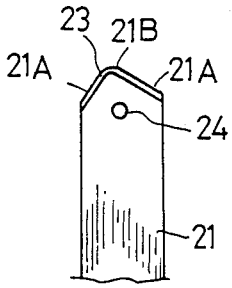

FIGS. 8 through 10 show examples of modified tip forms for the plug contact 21. In FIG. 8, diagonal edges 21A are formed on both sides of the centrally formed pointed part 21B, and a boss 24 is formed at the lateral center of the plug contact 21. In FIG. 9, the tip of the plug contact 21 is formed in an arc. Even with such an arc tip, contact with the coil barrel of the coil spring 13 starts with a point contact. Therefore, such an arc tip can easily expand a gap between coils of the coil spring 13. With an example shown in FIG. 10, a larger diagonal edge 21A and a small diagonal edge 21A' are formed at the tip of the plug contact 21, with a boss 24 displaced from a lateral center.

In each of the examples shown in FIGS. 8 through 10, a taper face 23 is formed in the direction of thickness at the tip of the contact 21.

Figure 11:
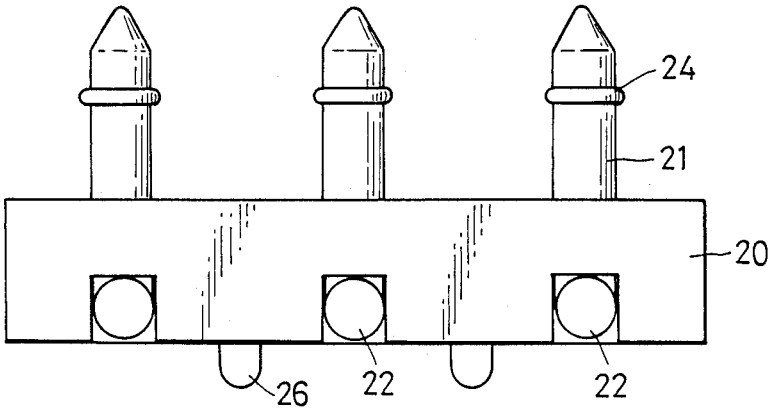
FIG. 11 is a plan view showing a plug connector using round-bar-type plug contacts.

In the embodiments of the plug connector 200 described, the plug contacts 21 are made from a metal sheet. However, the shape of another possible plug contact 21 is a round bar, as shown in FIG. 11. Where a round bar conductor is used for each plug contact 21, an annulus 24 is formed around each bar. When this annulus 24 is engaged between coils of the coil spring 13, click feeling for the insertion and resistance against pulling-out are assured.

Figure 12:
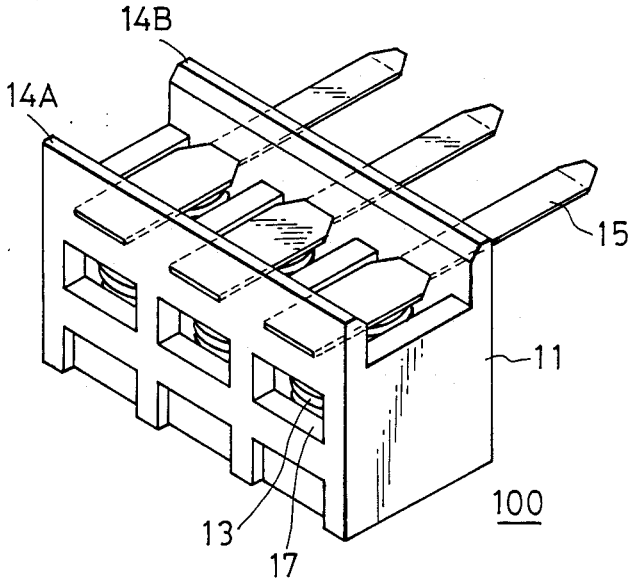
FIG. 12 shows an oblique view of another embodiment of the socket connector based on the present invention.
Figure 13:
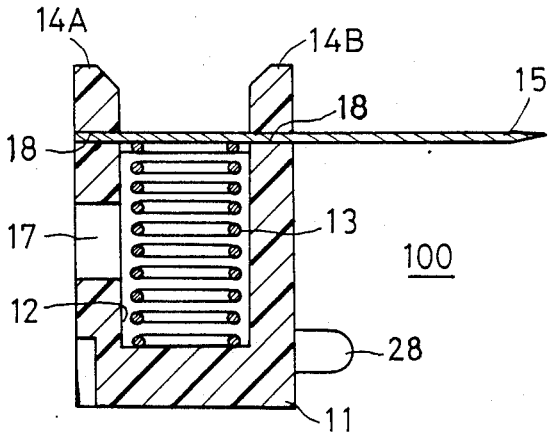
FIG. 13 is a sectional view of the socket connector shown in FIG. 12.

The socket connector 100 can be configured as shown in FIGS. 12 and 13. More explicitly, the spring housing holes 12 are formed in one surface of the square insulation block 11. Ridges 14A and 14B are formed on both sides of the spring housing holes 12. The protuberances 28 are provided on the rear side of the insulation block 11, for ascertaining the position of mounting the socket connector 100, the protuberances 28 being engaged with holes formed in a printed circuit board (not shown).

With this embodiment, three spring housing holes 12 are formed in one surface of the insulation block 11. In each spring housing hole 12, a coil spring 13 is inserted to serve as a contact. The open face of each spring housing hole 12 is covered with a terminal 15, and the coil spring 13 is compressed between the terminal 15 and the bottom of the spring housing hole 12.

Figure 14:
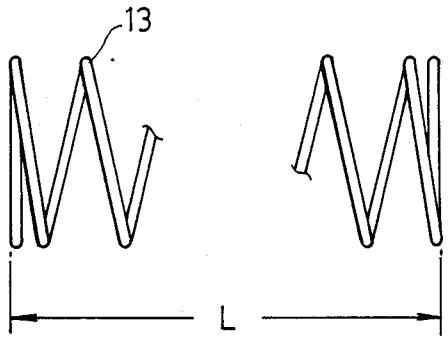
FIG. 14 shows a front view of the coil spring used in the socket connector in FIG. 12.

In other words, the coil spring 13 is of a normal winding type (gapped winding) in which there are rather larger gaps between respective coils, as shown in FIG. 14, in a free state. The coil spring 13 is made of a conductive resilient material such as phosphor bronze. Silver plating may be applied to the coil spring 13 while the latter is held in a free state to achieve uniform thickness of silver plating.

The free length L of the coil spring 13 is selected to be longer than the depth of the spring housing hole 12. When the spring is housed in the hole 12, the spring is compressed and deformed. The extent of its compression is so selected that each gap between coils of the coil spring 13 becomes smaller than the sheet thickness of the plug contact 21 of the plug connector 200.

Two ridges 14A and 14B are cut with slits 18 through which terminals 15 are pressed in, thus the terminals 15 are projected from the side surface of the insulation block 11 and supported therewith.

In addition, the opening of each spring housing hole 12 is closed by a part of the terminal 15 between the ridges 14A and 14B, thereby maintaining the coil spring 13 in a compressed state.

Figure 15:
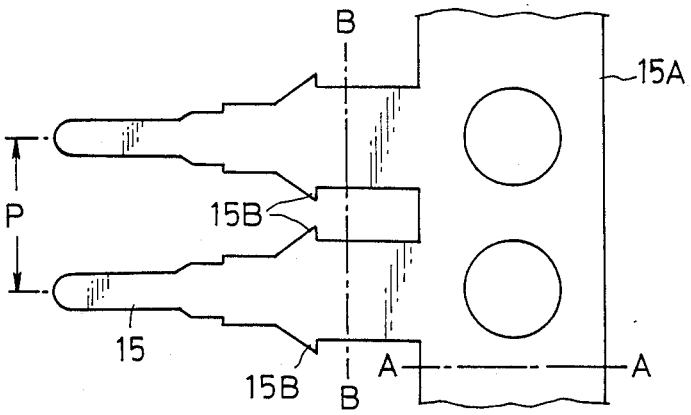
FIG. 15 illustrates a plan view of a terminal 15 shaped in a hoop.

The terminals 15 are punched out of a metal sheet in such a form that one ends of the terminals are connected with a connecting member 15A as shown in FIG. 15. In this state, the pitch of the terminals 15 is selected equal to that of terminals 16 which are to be mounted on the insulation block 11. The terminals 15 are plated, etc. while being held in connection with one another by means of the connecting member 15A, and loaded onto an automated mounting machine.

In the automated mounting machine, the connecting member 15 is cut off along a cutting line A (see FIG. 15) according to a specified length of the connecting member 15 corresponding to the number of terminals to be mounted in the insulation block 11. Each cut chip is automatically pressed into the slits 18 formed in the ridges 14A and 14B of the insulation block 11. After completing press-insertion into the ridges 14A and 14B, the terminals 15 are separated by cutting the chip along line B. Before press-inserting the terminals 15, the coil springs 13 are held in a compressed state in the spring housing holes 12 by using a jig (not shown). In this state, the terminals 15 are press-inserted into the slits 18, sliding through between the jig and the ends of the coil springs 13.

Hooks 15B (FIG. 15), formed on both sides of each terminals 15, engage with the resin body of the insulation block 11, working as stoppers for the terminal 15 after pressing-in.

Figure 16:
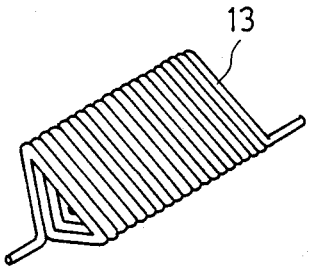
FIGS. 16–17 denote other embodiments of the coil spring based on the present invention in an oblique view.
Figure 17:
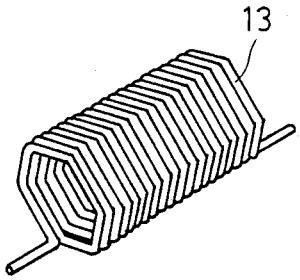

Each coil spring 13 may also be formed as a prism of 3–8 corners instead of being in the form of a circular cylinder, as shown in FIGS. 16 and 17.

Figure 18:
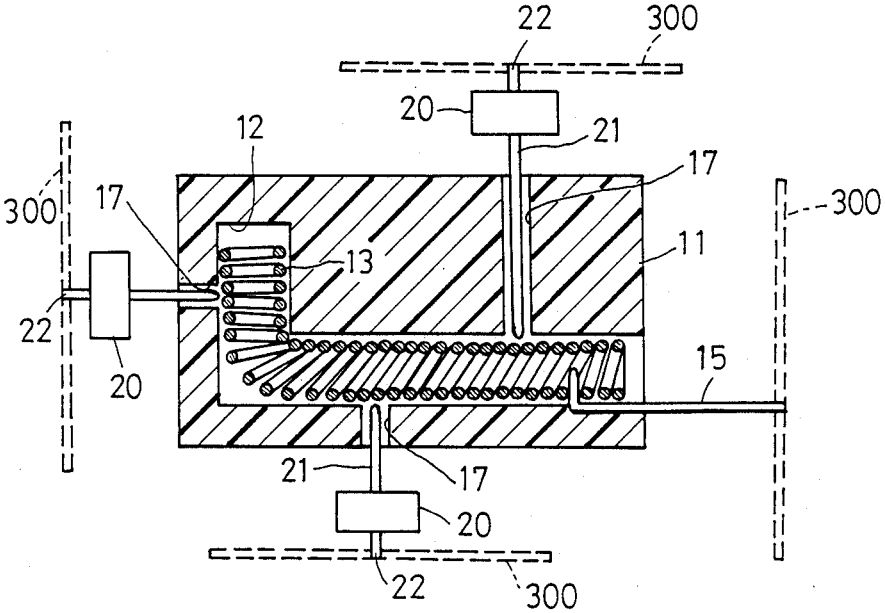
FIG. 18 is a sectional view of a socket connector which allows its coil springs to be connected to plug contacts from various directions.

With an embodiment shown in FIG. 18, rectangularly curved spring housing holes 12 are formed in the insulation block 11, and a plurality of contact insertion holes 17 are formed to extend from several surfaces of the insulation block 11 into each spring housing hole 12. Plug contacts 21 may be inserted into the contact insertion holes 17 from various directions with respect to the insulation block 11. Terminals 15, 22 may be connected to printed circuit boards 300 located separately.

Figure 19:
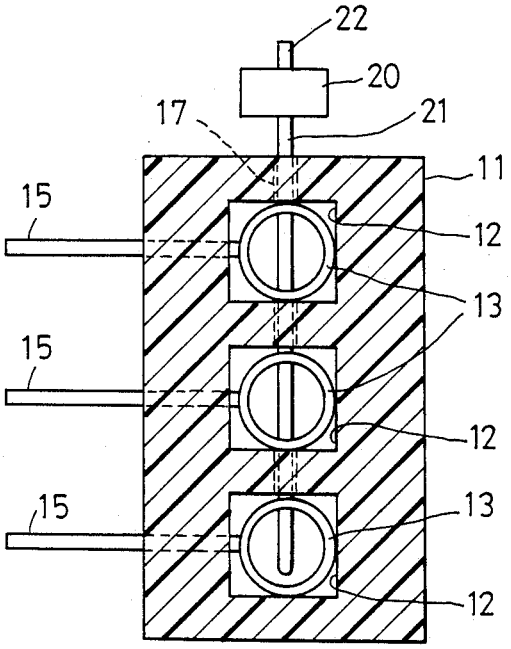
FIG. 19 shows a sectional view of a socket connector where a common plug contact is to be used for a plurality of coil springs.
Figure 20:
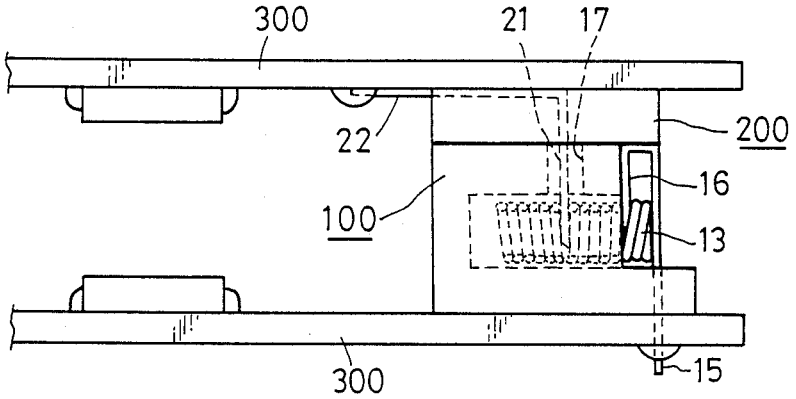
FIG. 20 is a side view of two printed circuit boards connected by means of a connector assembly provided according to the present invention.

FIG. 19 shows another example, in which a contact insertion hole 17 is formed in the arranging direction of spring housing holes 12, commonly to the holes 12. A plug contact 21 is inserted in the contact insertion hole 17 to allow common connection of the plug contact 21 to the three coil springs 13 in this example The socket connector 100 and the plug connector 200 shown in FIG. 3 may be mounted separately onto two oppositely disposed printed circuit boards 300, as shown in FIG. 20, for connecting these two printed circuit boards 300 to each other. In this case, the socket connector 100 and the plug connector 200 can be easily connected, even where there is a considerable positional discrepancy between the mounted socket connector 100 and plug connector 200 (in the axial direction of the coil spring), as long as the plug contacts 21 are insertable in the contact insertion holes 17. Compared to conventional connector assemblies, much larger positional discrepancy is permitted. Where a larger number of terminals are used in particular, the socket connector and the plug connector are easily engaged because of larger allowance for positional adjustment.

According to the present invention, a socket connector can be made smaller by using a coil spring as a contact for the socket connector. For example, the insulation block 11 is formed in a size of $3 \times 4$ mm sq., approximately, with a length of 7–8 mm for the 3-terminal type in 2.5 mm intervals between each terminal 15. Stable and good contact could be obtained with the coil springs 13 each of a wire diameter of 0.2 mm, coil barrel diameter of 1.5 mm in dense winding and with the plug contacts 21 of a thickness of 0.2 mm.

By using a strip plug contact 21, stable and good contact can be attained through multi-point contact, because the strip contact is resiliently clipped between coils of the coil spring 13.

When each plug contact 21 is engaged with the corresponding coil spring 13, friction occurs between the plug contact 21 and the coil spring 13, bringing about a cleaning effect which contributes to stabilizing contact resistance in advantageous conditions.

Even where the plug contact 21 is twisted adversely, the coil spring will probably not be deformed because of the coil spring 13 in use; thus a connector assembly with socket contacts highly resistant to twisting force is obtainable.

Where a boss 24 is formed on each plug contact 21 and inserted between coils of the coil spring 13, friction force occurs temporarily and suddenly changes occur during passage, thereby producing so-called click feeling. Consequently, the operator can feel that the plug connector 200 is certainly engaged with the socket connector 100 without fail. Even when a pulling force is applied to the plug connector 200 connected to the socket connector 100, the bosses 24 produce a resistive force whereby the connector plug will not be pulled off with a small force. Therefore, the necessary force for connecting/disconnecting the connector assembly can be made larger even with a reduced size of the connector assembly, while maintaining the coupling conditions in good stability for the connector assembly.

According to the embodiment shown in FIGS. 8 through 10, where a strip metal sheet is used as the plug contact 21 of a plug connector 200 while forming a pointed part 21B at the tip of the contact 21, this pointed part 21B comes in point contact with the barrel of the coil spring 13 when the contact 21 is inserted. In this state of point contact, the pointed part 21B expands the gap between coils of the coil spring 13, thereby the plug contact 21 becomes easily insertable into the coil spring 13.

If the tip of the plug contact 21 is shaped flat without forming a pointed part 21B apart from the scope of the principle of the present invention, the plug contact 21 may come in contact with two coils and push them simultaneously, provided that the coils of the coil spring 13 are constructed slantwise to the plate surface of the plug contact 21. Therefore, the pushing force acts on the coil spring 13 without expanding a gap between the coils and, in the extreme, the coil spring 13 may be collapsed accidentally.

Therefore, a highly safe connector, completely free from such an accident, is provided by forming a pointed part 21B at the tip of a contact 21, as described in the foregoing embodiments.

According to another embodiment of the socket connector shown in FIG. 12, the terminals 15 are inserted by pressing into the slits 18 formed in the ridges 14A, 14B of the insulation block 11 while being connected together by means of the connecting member 15A. Therefore, this operation of press-insertion can be easily performed using an automated machine suitable for mass production. In consequence, reduction in the cost of the connector assembly can be expected.

What is claimed is:

1. A socket connector comprising:

an insulation block having a spring housing hole formed in a first surface thereof, said spring housing hole being bent within said insulation block, and a plurality of contact insertion holes formed in said insulation block in different directions to communicate with said spring housing hole, a coil spring of a conducting material housed in said spring housing hole, said coil spring having its barrel placed opposite to said contact insertion holes, and at least one socket terminal supported by said insulation block, one end of said terminal being connected to said coil spring, and the other end of said terminal protruding from said insulation block.

2. A socket connector comprising an insulation block having a plurality of spring housing holes formed in a first surface thereof in line with the longitudinal direction of said insulation block, and a plurality of contact insertion holes formed in a second surface thereof in such manner that each such contact insertion hole communicates with at least one of said spring housing holes, a plurality of coil springs of a conducting material housed respectively in said spring housing holes, each said coil spring having its barrel placed opposite to one of said contact insertion holes, and a plurality of socket terminals supported by said insulation block, one end of each said terminal being inserted into an associated one of said spring housing holes and folded therein to engage the spring in said spring housing hole thereby to connect said terminal to said coil spring, and the other end of said terminal protruding from said insulation block.

3. The socket connector of claim 2, wherein said one end of each said terminal is located at a position which substantially closes an opening of the spring housing hole that houses the coil spring connected to said terminal.

4. The socket connector of claim 2, wherein a ridge is formed on said first surface of said insulation block integrally therewith to extend along the arrangement of said spring housing holes, said terminals being pressinserted and held in slits formed in said ridge.

5. The socket connector of claim 2 wherein a space is provided between the end of each said coil spring remote from said terminal and the bottom of said spring housing hole.

6. The socket connector of claim 1, wherein the barrel of each said coil spring is formed in a cylinder.

7. The socket connector of claim 2 wherein said plurality of said coil springs are housed with their axes held parallel to one another in said spring housing holes, one of said contact insertion holes being formed to laterally penetrate said spring housing holes in such a manner that said contact insertion hole communicates commonly with said spring housing holes.

8. The socket connector of claim 2, wherein a pair of ridges are formed integrally with said insulation block on both sides of said spring housing holes, a pair of slits being formed in said pair of ridges in opposing relation to each other across each said spring housing hole, said terminals being press-inserted and supported in said slits.

9. The socket connector of claim 8, wherein one end of each said coil spring is in resilient and electrical contact with a part of each said terminal between said pair of ridges.

10. The socket connector of claim 8, wherein said terminals are strip-shaped and disposed in parallel to one another on a substantially common plane.

* * * * *